US005929819A

United States Patent [19]

Grinberg

[11] Patent Number: 5,929,819

[45] Date of Patent: Jul. 27, 1999

[54] FLAT ANTENNA FOR SATELLITE COMMUNICATION

[75] Inventor: Jan Grinberg, Los Angeles, Calif.

[73] Assignee: Hughes Electronics Corporation, El Segundo, Calif.

[21] Appl. No.: 08/767,756

[22] Filed: Dec. 17, 1996

[51] Int. Cl.[6] ..... H01Q 19/06

[52] U.S. Cl. ..... 343/754; 343/753; 343/909

[58] Field of Search ..... 343/753, 754, 343/785, 755, 909, 911 L, 911 R, 700 MS; H01Q 19/06

[56] References Cited

U.S. PATENT DOCUMENTS

| | | | |
|---|---|---|---|
| 4,755,820 | 7/1988 | Backhouse et al. | 343/700 MS |
| 4,791,427 | 12/1988 | Raber et al. | 343/754 |
| 5,005,022 | 4/1991 | Blaisdell | 343/753 |
| 5,453,752 | 9/1995 | Wang et al. | 343/700 MS |
| 5,486,835 | 1/1996 | Hock | 342/359 |
| 5,511,238 | 4/1996 | Bayraktaroglu | 343/700 MS |
| 5,675,349 | 10/1997 | Wong | 343/911 R |
| 5,708,444 | 1/1998 | Pouwels et al. | 343/700 MS |

*Primary Examiner*—Don Wong
*Assistant Examiner*—Hoang Nguyen
*Attorney, Agent, or Firm*—V. D. Duraiswamy; M. W. Sales

[57] ABSTRACT

A low profile receiving and/or transmitting antenna includes an array of lenses that focuses millimeter wave or other radiation onto a plurality of conventional patch antenna elements. The lenses and antenna elements are physically configured so that radiation at a tuning wavelength impinging on the antenna at a particular angle of incidence is collected by the lenses and focused onto the antenna elements in-phase. Two rotatable prisms may be disposed above the lenses to alter the angle of incidence of incoming or outgoing radiation to match the particular angle of incidence.

29 Claims, 5 Drawing Sheets

FIG. 3
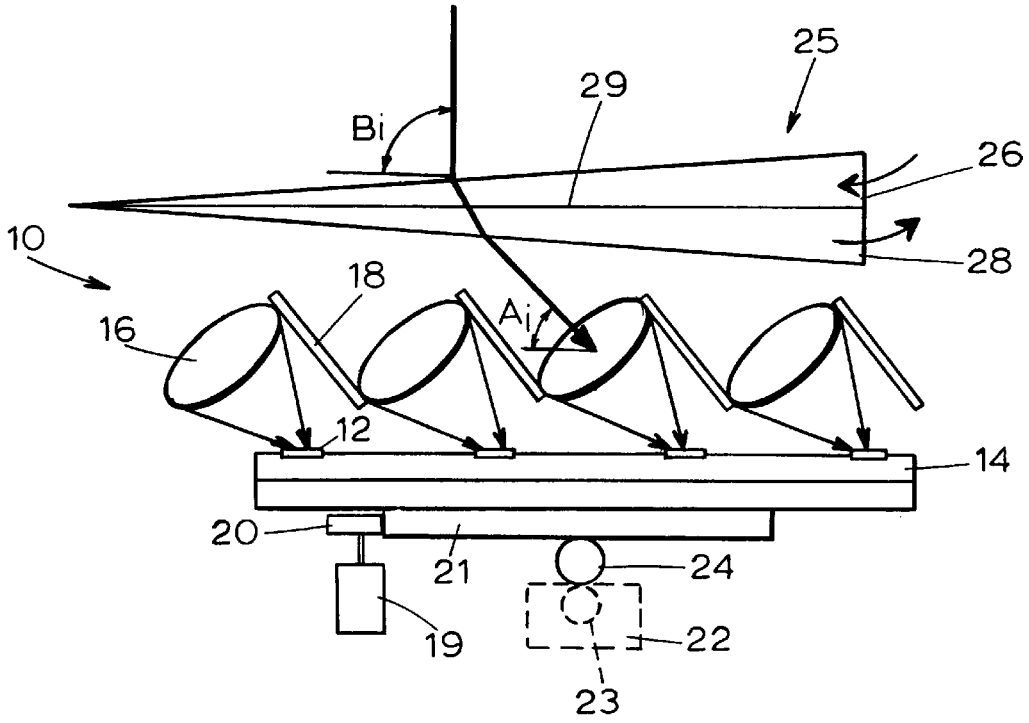
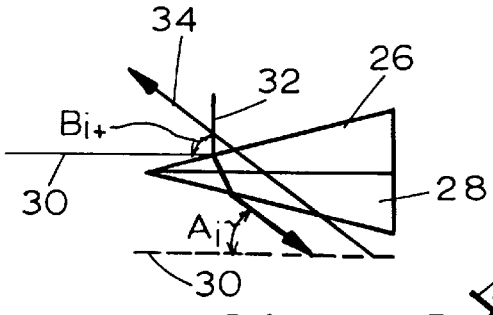
FIG. 4A
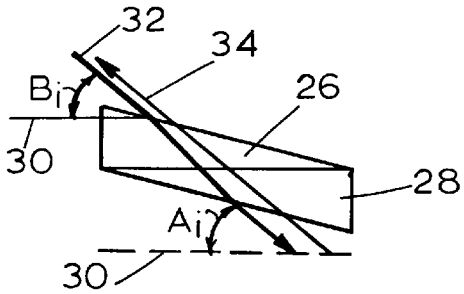
FIG. 4B
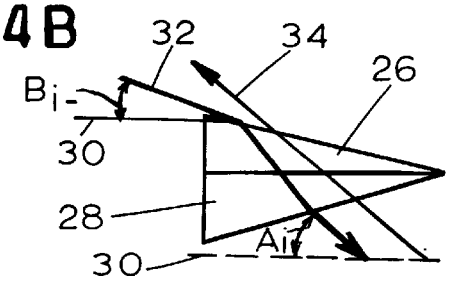
FIG. 4C

FLAT ANTENNA FOR SATELLITE COMMUNICATION

BACKGROUND OF THE INVENTION (a) Field of the Invention

The present invention relates generally to antennas and, more particularly, to low profile receiving/transmitting antennas, such as flat antennas, used in communication systems.

(b) Description of Related Art

Satellites are commonly used to relay or communicate electronic signals, including audio, video, data, audio-visual, etc. signals, to or from any portion of a large geographical area, such as the continental United States. A satellite-based signal distribution system generally includes an earth station that compiles one or more individual audio/visual/data signals into a narrowband or broadband signal, modulates a carrier frequency band with the compiled signal and then transmits (uplinks) the modulated signal to one or more, for example, geosynchronous satellites. The satellites amplify the received signal, shift the signal to a different carrier frequency band and transmit (downlink) the frequency shifted signal to earth for reception at individual receiving units. Likewise, individual receiving units may transmit a signal, via a satellite, to the base station or to other receiving units.

Many satellite communication systems, including some commercial and military mobile communication systems as well as a direct-to-home satellite system developed by DIRECTV® and known commercially as DSS®, use millimeter wave (MMW) carrier frequencies, such as Ku band (ranging from approximately 12 GHz to 18 GHz), to transmit a signal from the satellite to one or more receiver units and/or vise-versa.

In particular, the DSS system uses an uplink signal having 16 right-hand circular polarized (RHCP) transponder signals and 16 left-hand circular polarized (LHCP) transponder signals modulated onto the frequency band between about 17.2 GHz and about 17.7 GHz. The satellites associated with the DSS system shift the uplink transponder signals to carrier frequencies ranging from approximately 12.2 GHz to approximately 12.7 GHz and transmit these frequency-shifted transponder signals back to earth for reception at each of a plurality of individual receiver units. At each individual receiver unit, a receiving antenna, typically comprising a parabolic dish antenna, is pointed in the general direction of the transmitting satellite (or other transmitting location) to receive the broadband signal.

While the dish antennas associated with the DSS and other communication systems are generally acceptable for receiving satellite signals at stationary receivers, these antennas are typically too large and cumbersome to mount on mobile receivers, such as cars, buses, trucks, tanks, airplanes, helicopters, etc. With mobile receivers, it is desirable to use a receiving/transmitting antenna which is small, to reduce the space necessary for mounting the antenna, and which has a low profile, to reduce the wind resistance caused by the antenna.

Furthermore, mobile antennas must be capable of receiving satellite signals at a range of angles of incidence due to the fact that the angle of incidence of any particular satellite signal changes as the mobile antenna moves across a large geographical area such as the continental United States. In fact, the angle of incidence of a typical geosynchronous satellite signal changes by approximately 23 degrees as an antenna travels across the continental United States.

In the past, flat mobile antennas have been developed using electronically steered phased array antennas which have a number of individual receiving elements positioned in a flat plane. The phase of each of the receiving elements is electronically controlled in a manner which steers the beam of the antenna to different azimuth and elevation angles without moving the antenna. While phased array antennas produce acceptable mobile receiving antennas, they are typically hard to maintain and are expensive to build due to the complexity of the electronic control associated with these antennas.

Continuous transverse stub (CTS) antennas may be used to produce receiving/transmitting antennas. However, it is difficult to design small, low profile CTS antennas that have the required efficiency or antenna gain that is necessary to receive satellite communication signals adequately due, in part, to the fact that CTS antennas do not collect radiation across the entire aperture associated with the antenna and due, in part, to the fact that CTS antennas tend to retransmit some of the collected radiation.

SUMMARY OF THE INVENTION

The present invention relates to a low profile receiving and/or transmitting antenna comprising an array of lenses that focuses millimeter wave or other radiation onto a plurality of conventional antenna elements. The lenses and antenna elements are physically configured so that the radiation at a tuning wavelength impinging on the antenna at a particular angle of incidence is collected by the lenses and is focused on the antenna elements in-phase. This construction allows summing networks to sum the signals collected by the antenna elements without the necessity of electronic phase control while simultaneously producing a sufficiently high antenna gain which allows the antenna to be used with relatively low power satellite communication systems.

According to one aspect of the present invention, an antenna comprises a plurality of antenna elements, such as half-wave patch elements, disposed within a substrate and a plurality of lenses disposed adjacent the antenna elements. Each of the lenses is disposed at a particular angle of incidence with respect to the substrate so that each of the lenses collects and focuses radiation impinging on the lens at the particular angle of incidence onto an associated one of the antenna elements. The lenses may be disposed in an array of rows and columns so that the lens within each column are in a single plane and so that the lenses in adjacent columns are recessed with respect to one another. Preferably, adjacent lenses within each row are separated by a lens-to-lens recess equal to approximately an integer multiple of the particular wavelength to which the antenna is tuned so that radiation is collected by the antenna elements in-phase.

The antenna may include one or more devices to steer the beam associated with the antenna. In particular, mechanical or motorized means may rotate the substrate in the azimuth direction to steer the antenna beam in the azimuth direction and/or may tilt the antenna to steer the antenna beam in the elevational direction for both reception and transmission. Alternatively, two rotatable prisms may be disposed adjacent the plurality of lenses to steer the antenna beam in the elevational direction while the antenna is receiving or transmitting.

According to another aspect of the present invention, a reception/transmission antenna comprises an antenna receiver/transmitter, having an antenna beam pointed in a beam direction, and two prisms disposed adjacent the antenna receiver/transmitter for altering the beam direction associated with the antenna during both signal reception and signal transmission. Preferably, the two prisms are rotatable to change the beam direction over a range of beam directions and have adjacent surfaces which are parallel to an antenna element plane associated with the receiver/transmitter.

BRIEF DESCRIPTION OF THE DRAWINGS

FIG. 3 is a diagrammatic view of a second embodiment of the antenna according to the present invention;

FIGS. 4A–4C are diagrammatic views illustrating the operation of a beam steering device having two prisms disposed in different relative positions;

DESCRIPTION OF THE PREFERRED EMBODIMENTS

By the way of example only, the low profile receiving/transmitting antenna of the present invention is described herein as being constructed for use with a MMW geosynchronous satellite communication system. It should be understood, however, that an antenna could be constructed according to the principles disclosed herein for use with other desired satellite or ground-based, audio, video, data, audio-visual, etc. signal distribution systems including, for example, so-called "C-band" systems (which transmit at carrier frequencies between 3.7 GHz and 4.2 GHz), land-based wireless distribution systems such as MMDS (multi-channel, multi-point distribution systems) and LMDS (local multi-point distribution systems), cellular phone systems, the DSS system, etc. In fact, a receiving antenna could be constructed according to the principles disclosed herein for use with communication systems which transmit at wavelengths less than the MMW range, such as sub-millimeter wave and terra-wave communication systems, or at wavelengths greater than the MMW range, such as microwave communication systems. In the latter case, however, the antenna will be larger and, therefore, less useful as a low profile antenna.

Figure 1:
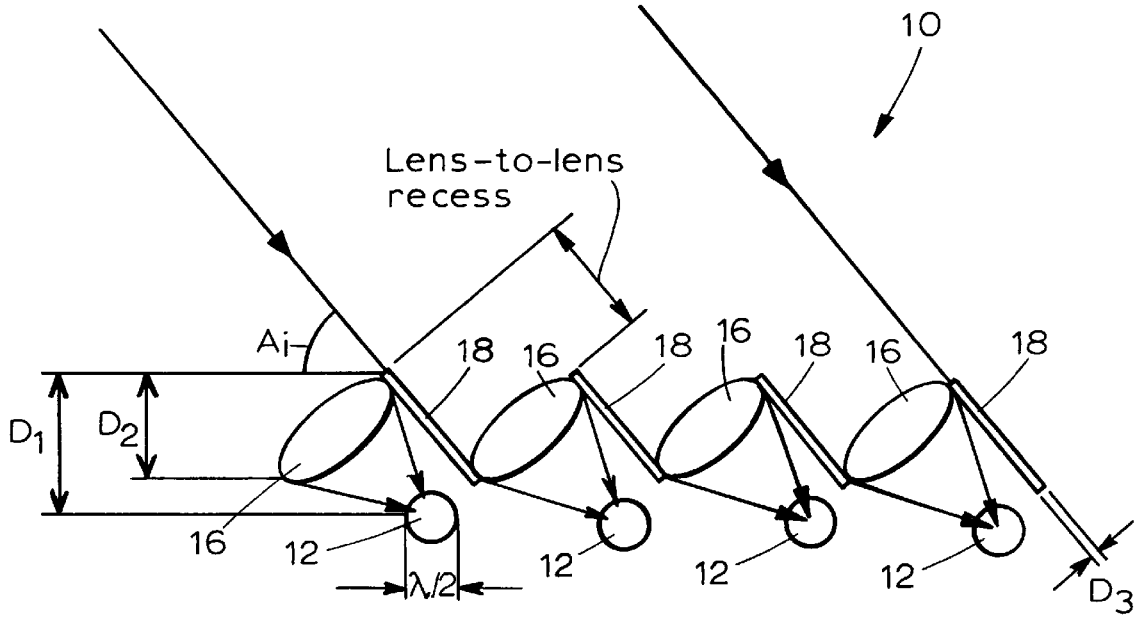
FIG. 1 is a two-dimensional, diagrammatic view of one embodiment of the antenna according to the present invention.
Figure 2:
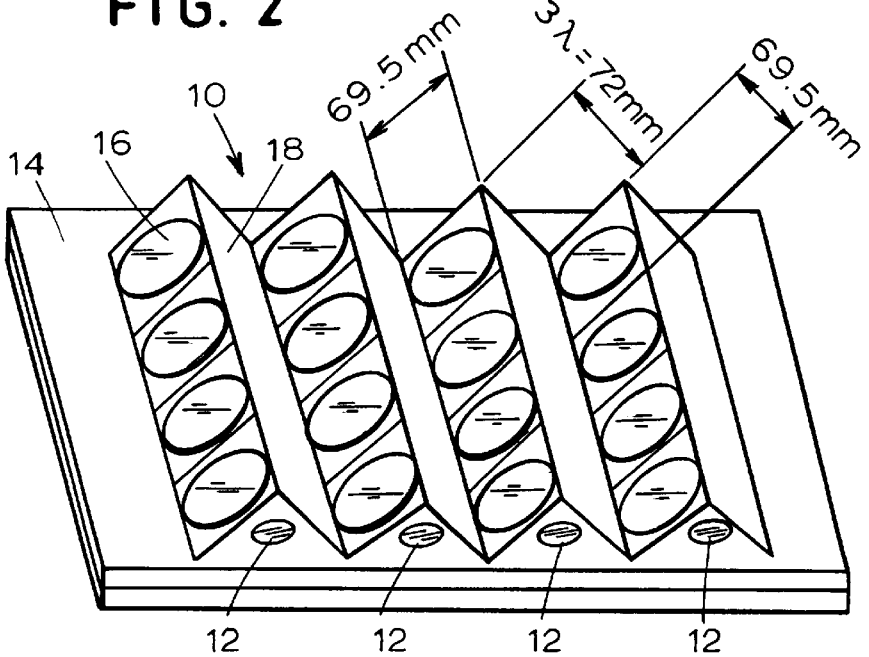
FIG. 2 is a three-dimensional, perspective view of the antenna of FIG. 1.

Referring now to FIGS. 1 and 2, a signal receiving/transmitting antenna 10 according to the present invention is illustrated in detail. The antenna 10 includes a receiver/transmitter comprising an array of conventional antenna elements 12 disposed on or in a substrate 14 which may be made using, for example, microstrip construction methods. The antenna elements 12 are preferably patch elements such as circular metal pads having a diameter of one-half of the wavelength ($\lambda$) of the signal to which the antenna 10 is tuned and are disposed in the substrate 14 in a regular pattern, illustrated in FIG. 2 as a four-by-four rectangular pattern. However, the antenna elements 12 could comprise any other type of antenna receiving and/or transmitting elements such as those using an optical tube structure and could be disposed in any other desired rectangular pattern including, for example, a 3×5 array, a 2×4 array, a 5×8 array, or any non-rectangular pattern including, for example, any circular, oval or pseudo-random pattern.

An array of lenses 16 is disposed above the antenna elements 12 such that each of the lenses 16 points in a lens direction that is at an angle of incidence $A_i$ with respect to the plane in which the antenna elements 12 are disposed, for example, the plane of the substrate 14. As illustrated in FIG. 1, the lens direction of the lenses 16 is along a line normal to the plane passing through the center of one of the lenses 16 in the longitudinal direction. Each of the lenses 16, which may be a Fresnel lens made of any desired type of plastic, glass or any other desired lens material, focuses radiation arriving at the angle of incidence $A_i$ onto an associated one of the antenna elements 12 in-phase.

Preferably, the lenses 16 are separated from one another by an edge plane 18 made of any suitable material that holds the lenses 16 in place. Also preferably, the lenses 16 within adjacent columns (as illustrated in FIG. 2) have a lens-to-lens-recess equal to approximately an integer multiple of the wavelength $\lambda$ to which the antenna 10 is tuned while the lenses 16 in the same column are disposed in a single plane. As illustrated in FIG. 1, the lens-to-lens recess is determined as the distance between the center planes of two adjacent lenses 16 along a line perpendicular to the center planes of those lenses, i.e., along a line in the lens direction. When the lens-to-lens recess between adjacent lenses 16 is an integer multiple of the wavelength of the impinging radiation $\lambda$, the antenna elements 12 collect the impinging radiation in-phase. Thereafter, the radiation collected in-phase by the antenna elements 12 is summed (in-phase) by any standard radiation summing network and delivered to a receiving unit (not shown) for amplification and demodulation.

In the embodiment illustrated in FIGS. 1 and 2, the antenna 10 is tuned to receive signals having a wavelength of approximately 24 mm (millimeters), i.e., 12.5 GHz, at an angle of incidence $A_i$ equal to 44 degrees. The lens-to-lens recess of the antenna 10 is illustrated as being three times the tuning wavelength $\lambda$, i.e, 72 mm. The diameter of each of the antenna elements 12 in FIGS. 1 and 2 is twelve millimeters and, preferably, the diameter of each of the lenses 16 is approximately 69.5 mm. The perpendicular distance $D_1$ from a plane that is parallel to the substrate 14 and that passes through the uppermost portion of each of the lenses 16 to the plane of the antenna elements 12 is 75 mm while the perpendicular distance $D_2$ from a plane that is parallel to the substrate 14 and that passes through the uppermost portion of each of the lenses 16 to a plane that is parallel to the substrate 14 and that passes through the lowermost portion of each of the lenses 16 is 50 mm. Also preferably, the edge planes 18 are approximately two millimeters in width ($D_3$), the distance between the centers of adjacent antenna elements 12 within each row of the array illustrated in FIGS. 1 and 2 is 100 mm and the distance between the center of adjacent antenna elements 12 within each column of the array is 69.5 mm. However, as would be evident to one skilled in the art, other desired distances and spacings could be used instead of those specifically described and illustrated herein.

It has been determined that an antenna configured according to the principles set out herein reduces the so-called grating lobes of the antenna beam due to the small lens-to-lens separation. Furthermore, because the lenses 16 focus most of the radiation impinging on the antenna 10 at the angle of incidence $A_i$ across the entire aperture of the antenna 10 onto the antenna elements 12, the antenna 10 has a relatively high antenna gain, which enables the antenna 10 to be used for satellite communication purposes.

It is noted that the azimuth pointing angle of the antenna 10 can be changed by rotating the substrate 14 along with the lenses 16 and the antenna elements 12 using any desired mechanical or motor driven device. Furthermore, the elevational pointing angle of the antenna 10 can be changed by tilting the substrate 14 along with the lenses 16 and the antenna elements 12 using any conventional mechanical or motor driven device. In this manner the beam of the antenna 10 may be steered to receive or to transmit signals from or to a moving source/receiver, from or to more than one signal source/receiver or to account for movement of the antenna with respect to a stationary or a moving source/receiver.

Referring now to FIG. 3, an embodiment of the antenna 10 including beam steering capabilities is illustrated. The steerable antenna 10 includes a motor 19 which drives a gear 20 to rotate against a circular gear 21 attached to a lower portion of the substrate 14. Operation of the motor 19 rotates the antenna 10 in the azimuth direction to thereby steer the antenna beam in the azimuth direction. Likewise, a motor 22 and gear 23 (illustrated in phantom relief) may be provided to drive a gear 24 attached to a center portion of the lower surface of the substrate 14 to tilt the antenna 10 in elevation, thereby steering the beam of the antenna 10 in the elevational direction. If desired, a standard feedback loop controller may operate the motors 19 and 22 to maximize the signal strength of a received signal. Of course, any other mechanical, electrical or motorized device may be used to rotate and/or tilt the antenna 10 as desired.

In an alternative embodiment, the motor 22 and gears 23 and 24 may be replaced with a beam steering device 25 disposed between the lenses 16 and a source of received radiation (or an intended receiver of transmitted radiation). The beam steering device 25 preferably includes two adjacent prisms 26 and 28 disposed such that they have adjacent surfaces 29 parallel to the plane of the antenna elements 12. The beam steering device 25 operates to bend impinging radiation arriving at an angle of incidence $B_i$ (measured as the angle between the direction of propagation of the impinging radiation and the plane of the antenna elements 12) to the angle of incidence $A_i$ for which the antenna 10 was designed, wherein the angle $A_i$ is measured as the angle between the pointing direction of the lenses 16 and the plane of the antenna elements 12. As will be evident, the difference between the elevational angles $B_i$ and $A_i$ is dependant on the specific configuration of the prisms 26 and 28 and on the position of the prisms 26 and 28 relative to the substrate 14 and to each other. The elevational angle $B_i$ can be varied between a maximum angle $B_{i+}$ and a minimum angle $B_{i-}$ by rotating the prisms 26 and 28 in opposite directions.

FIGS. 4A–4C illustrate three different positions of the rotating prisms 26 and 28, wherein planes parallel to the plane of the antenna elements 12 are illustrated as dotted lines 30, the direction of incoming radiation is indicated as a line 32 and the lens pointing direction is indicated as a line 34. FIG. 4A illustrates the prisms 26 and 28 rotated so that their larger ends are disposed together above the right side of the antenna 10 and provide for maximum decrease in the angle of incidence $B_i$ so that, for example, the angle of incidence $B_i$ changes from $B_{i+}$ (illustrated as approximately 80 degrees) to a design angle of incidence $A_i$ (illustrated as approximately 44 degrees). FIG. 4B illustrates the prisms 26 and 28 rotated so that their larger ends are on directly opposite sides of the antenna 10 and produce no change in the angle of incidence $B_i$, i.e., $B_i$ equals $A_i$. FIG. 4C illustrates the prisms 26 and 28 rotated so that their larger ends are disposed together above the left side of the antenna 10 and provide for maximum increase in the angle incidence $B_i$ so that, for example, the angle of incidence $B_i$ changes from $B_{i-}$ (illustrated as approximately 8 degrees) to a design angle of incidence $A_i$ (approximately 44 degrees).

The prisms 26 and 28 can be rotated independently and/or simultaneously (preferably in opposite directions) by any standard mechanical or motorized mechanism to vary the amount of beam steering to be any amount between the maximum angle of incidence of impinging radiation $B_{i+}$ and the minimum angle of incidence of impinging radiation $B_{i-}$ associated with the specific configuration of the prisms 26 and 28. In other words, the beam of the antenna 10 can be steered to all the angles between the angles $B_{i+}$and $B_{i-}$ by rotating the prisms 26 and 28 in opposite directions to different relative positions. If desired, the prisms 26 and 28 may be formed in a circular configuration having gears on outer edges thereof which mesh with motor driven gears to provide rotation of the prisms 26 and/or 28.

Preferably, the prisms 26 and 28 are designed to provide the maximum beam steering considered necessary for the particular use of the antenna 10. As is evident, the maximum beam steering necessary for any particular antenna will be dependant on the amount of expected change in the angle of incidence of the received signal (in the case of a receiving antenna) or in the position of the receiver (in the case of a transmitting antenna) and on the width of the antenna beam, which is a function of the size or aperture of the antenna. The larger the aperture, the narrower the beam. Thus, for example, in the case of a relatively narrow beam antenna which is to be used to receive a geosynchronous satellite signal at any position within the continental United States, it is desirable to be able to steer the antenna beam in elevation approximately plus and minus 11.5 degrees away from the design angle of incidence $A_i$.

Figure 5:
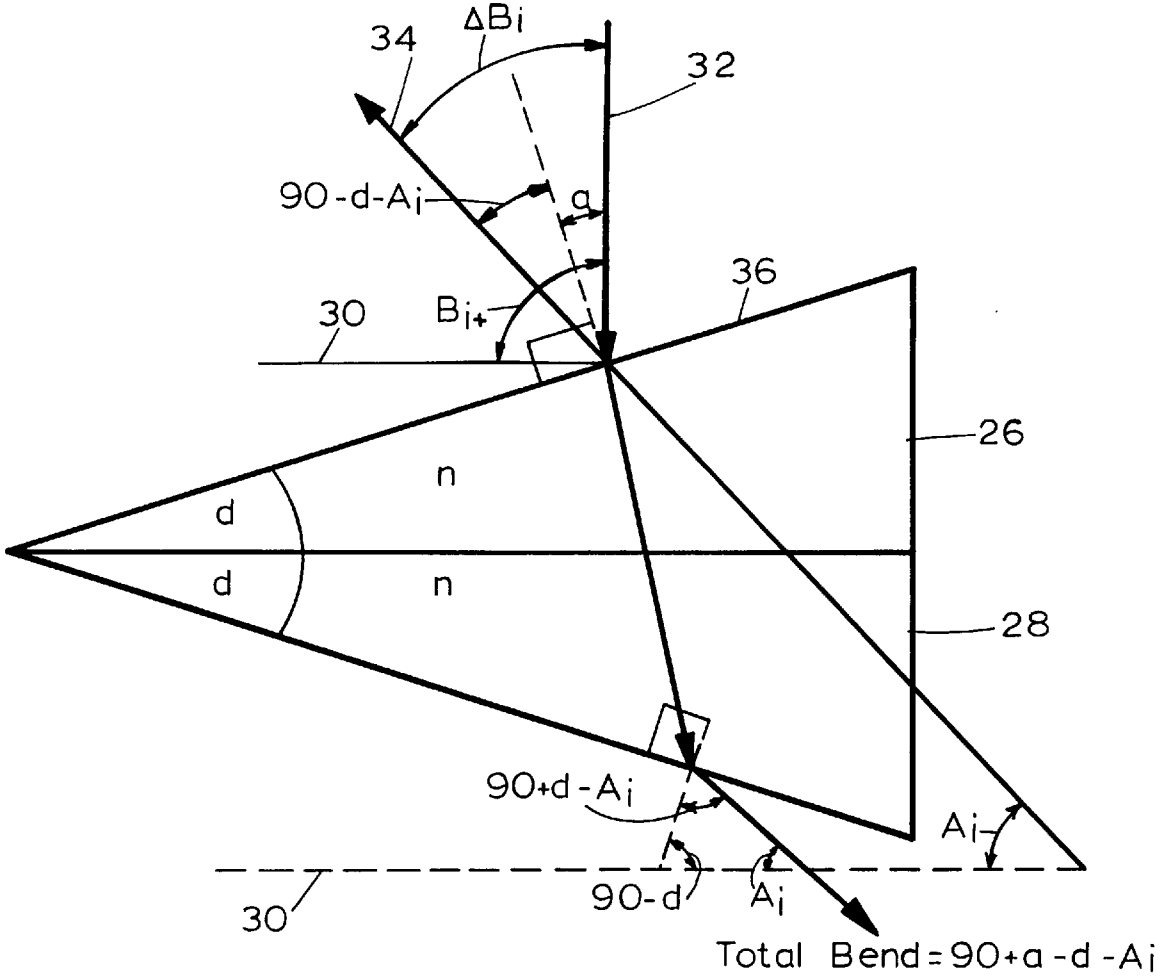
FIG. 5 is a diagrammatic view of the two prisms of FIGS. 4A–4C illustrating the angles used in calculating the beam steering capabilities of the two prisms.

With reference to FIG. 5, the maximum elevational steering capabilities of the antenna 10 (i.e., the maximum change between the angle of incidence $B_i$ of the impinging radiation and the design angle of incidence $A_i$ of the antenna 10) is a function of the prism angle d and the refractive index n of the prisms 26 and 28 and the design angle of incidence $A_i$ of the antenna 10. Preferably, the prisms 26 and 28 are identical. In such a case, the maximum change in the steering angle $\Delta B_i$ (i.e., the value of $B_{i+}-A_i$) can be determined for the prisms 26 and 28 by solving for the entrance angle a using the following equation:

$$\sin(a)=\sin(2d)[[n^2-\cos^2(A_i-d)]^{1/2}-\cos(2d)\cos(A_i-d)] \quad (1)$$

wherein:

a=the angle between the incoming radiation and the normal to the surface 36 (of the prism 26) facing away from the antenna 10;

d=the prism angle of the prisms 26 and 28;

n=the index of refraction of the prisms 26 and 28; and $A_i$=the design angle of incidence for the antenna 10, all as illustrated in FIG. 5.

After solving equation (1) for the entrance angle a, the maximum change in the steering angle $\Delta B_i$ can be determined as:

$$\Delta B_i=|90+a-d-A_i| \quad (2)$$

As is evident, the maximum radiation angle of incidence $B_{i+}$ which the prisms 26 and 28 will be able to bend to the design angle of incidence $A_i$ is equal to $A_i+\Delta B_i$ while the minimum radiation angle of incidence $B_{i-}$ which the prisms 26 and 28 will be able to bend to the design angle of incidence $A_i$ is equal to $A_i-\Delta B_i$. Of course equations (1) and (2) can be calculated for any desired set of prisms to determine a set of prisms which matches a particular steering requirement. As noted above, the steering angles between the angles $B_{i-}$ and $B_{i+}$ can be obtained by rotating the prisms 26 and 28 in opposite rotational directions between the positions illustrated in FIGS. 4A and 4C.

While the prisms 26 and 28 are illustrated and described herein as being identical prisms, the prisms 26 and 28 could different, having different indices of refraction n and/or prism angles d and/or could be disposed at different orientations with respect to the plane of the antenna elements 12 to alter the angle of incidence $B_i$ in a different manner. Furthermore, the higher the index of refraction n of the prisms 26 and 28, the smaller the prism angle d can be and, therefore, the narrower the prisms 26 and 28 can be.

Figure 6:
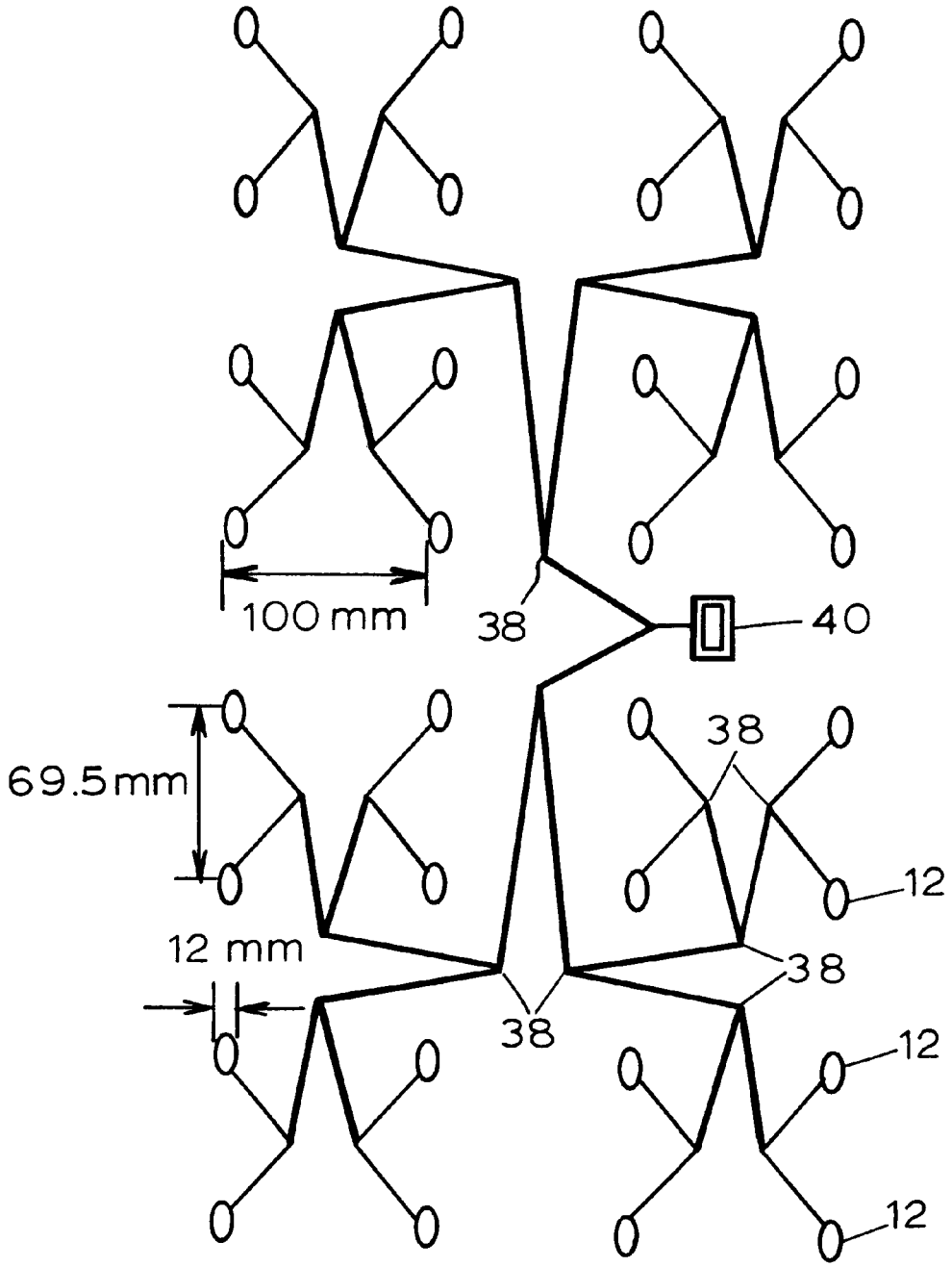
FIG. 6 is a top plan view of a conventional corporate feed lay-out for use with the antenna of the present invention.

FIG. 6 is a top plan view of a substrate having disposed thereon an array of eight rows and four columns of antenna elements 12, each of which is preferably 12 mm in diameter. In this example, the rows of antenna elements 12 are separated by 69.5 mm while the columns of antenna elements are separated by 100 mm. The antenna elements 12 are electrically or electro-magnetically interconnected with a series of, for example, waveguides or microstrip paths disposed within the substrate 14 such that each of the antenna elements 12 is connected through a plurality of summing junctions 38 to a summer 40. Notably, the distance from each antenna element 12 to the summer 40 is the same for all of the antenna elements 12 so that all signals are summed in-phase. The signals from different antenna elements or groups of antenna elements may be combined using any known summing devices including, for example, Wilkinson combiners. The advantage of Wilkinson combiners is that all of the components and connections between the antenna elements are shielded and are in one plane, which eliminates plane-to-plane feed-through.

While FIG. 6 illustrates one possible layout of an 8×4 antenna, a similar layout could be used for smaller or larger arrays of antenna elements. Furthermore, other types of known feed layouts could be used to manufacture the antenna 10 according to the present invention.

While, preferably, the antenna 10 is designed to have a lens-to-lens recess that is equal to an integer multiple of the wavelength to which the antenna is tuned so that all radiation at the tuned wavelength impinging on the antenna elements 12 is in-phase, the lens-to-lens recess could be other than an integer multiple of the wavelength and the distances between the antenna elements 12 and the summer junctions 38 and/or 40 could be different to make all of the radiation arriving at each summer junction 38 and 40 in-phase. However, this configuration is considered to be more difficult to design and manufacture due to the necessary construction of signal paths of different lengths within the substrate 14.

Figure 7:
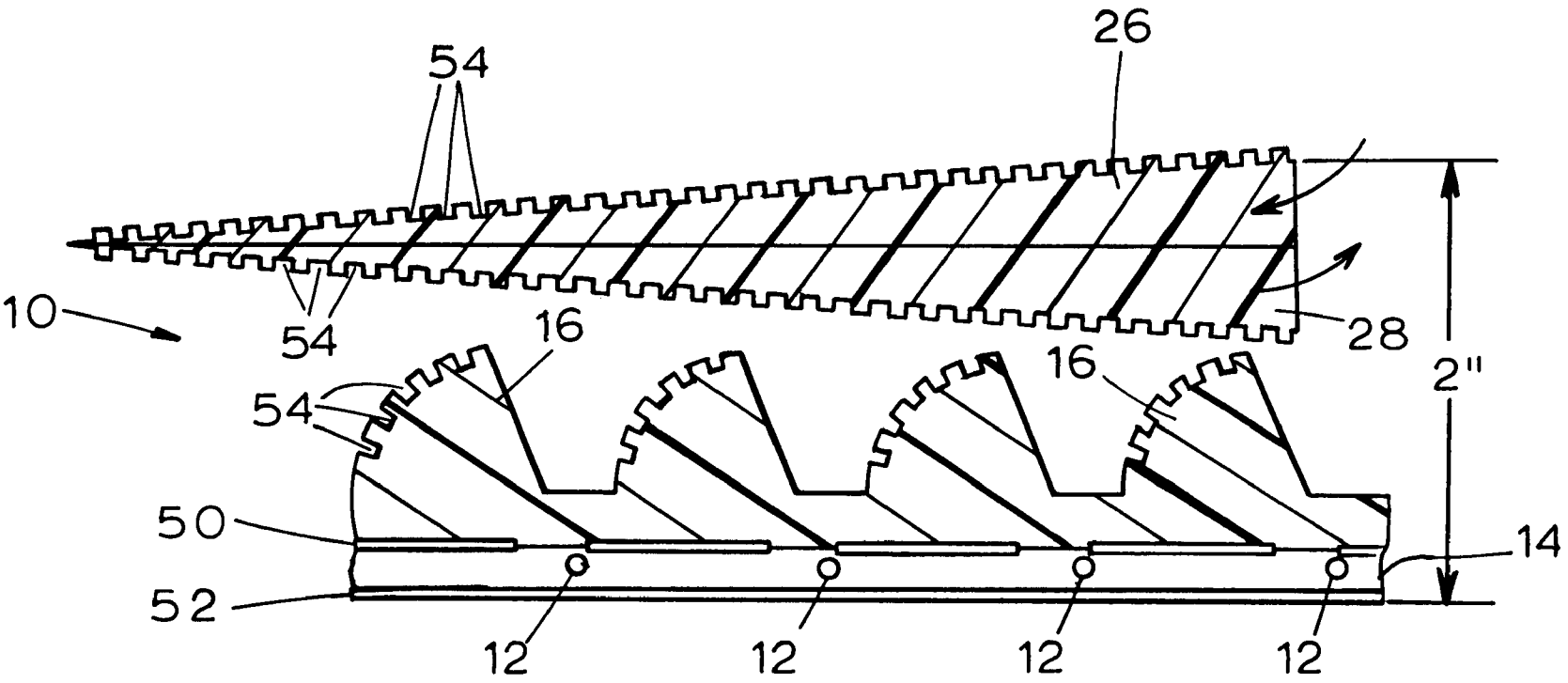
FIG. 7 is a cross-sectional view of a further embodiment of the antenna according to the present invention.

Referring now to FIG. 7, a low profile, low cross-section antenna having a total height of two inches is illustrated using the concepts of the present invention. In this configuration, the antenna elements 12 comprise openings within the upper surface of the substrate 14 which are designed to collect incoming radiation (or transmit outgoing radiation) in a manner known in microstrip antenna construction. The antenna elements 12 of FIG. 7 are disposed between two metal layers 50 and 52, wherein the upper layer 50 is etched using standard microstrip methods to allow radiation to propagate from the lenses 16 to the elements or openings 12 and vise-versa. The lenses 16 are made of a solid piece of, for example, injection molded plastic, which is disposed directly adjacent the upper metal layer 50 of the microstrip substrate 14. The prisms 26 and 28 are also made of any desirable material, such injection molded plastic or glass.

To reduce reflection losses and, thereby, increase the antenna gain, the surfaces of the prisms 26 and 28 as well as the surfaces of the lenses 16 may have any standard anti-reflection coatings placed thereon. Each such standard anti-reflection coating comprises a dielectric material which has an index of refraction which is preferably between the index of refraction of free space and the index of refraction of the prism/lens material and is also preferably one-quarter of the tuning wavelength in thickness. Alternatively, grooves 54 having a depth of one-quarter of the tuning wavelength may be etched into the surfaces of the prisms 26 and 28 and/or the lenses 16 to produce an anti-reflection layer, as is generally known in the art.

In the embodiment of FIG. 7, as in any of the disclosed embodiments, the prisms 26 and 28 and/or the substrate 14 may be rotated (or tilted) by any simple mechanical or motorized rotating devices to steer the antenna beam in the azimuth and elevational directions. Furthermore, if desired, the antenna 10 could be reduced in height by eliminating the lenses 16 and using the prisms 26 and 28 to steer incoming radiation directly onto a set of antenna elements 12, although this configuration reduces the gain of the antenna significantly.

While the present invention has been described with reference to specific examples, which are intended to be illustrative only, and not to be limiting of the invention, it will be apparent to those of ordinary skill in the art that changes, additions and/or deletions may be made to the dissclosed embodiments without departing from the spirit and scope of the invention.

What is claimed is:

1. An antenna comprising:

a plurality of antenna elements disposed in an antenna plane; and a plurality of lenses disposed adjacent the antenna elements, wherein an optical axis of each of the lenses is oriented at a particular angle of incidence with respect to a normal to the antenna plane, said angle of incidence being other than substantially perpendicular to said antenna plane, said lenses thereby being able to collect and focus radiation impinging on the lenses at the particular angle of incidence and onto associated antenna elements.

2. The antenna of claim 1, wherein the antenna is designed to receive radiation at a particular wavelength, and wherein at least one set of two adjacent lenses of the plurality of lenses are disposed apart with a lens-to-lens recess of approximately an integer multiple of the particular wavelength.

3. The antenna of claim 1, wherein the plurality of lenses are disposed in an array of columns and rows so that the lenses within each column are disposed in a single plane and so that the lenses in adjacent columns are recessed with respect to each other.

4. The antenna of claim 3, wherein the antenna is designed to receive radiation at particular wavelength and wherein the lenses of two adjacent columns of the array are disposed apart with a lens-to-lens recess of approximately an integer multiple of the particular wavelength.

5. The antenna of claim 1, further including means for steering an antenna beam associated with the antenna.

6. The antenna of claim 5, wherein the antenna elements are disposed within a substrate and the steering means includes means for rotating the substrate in the azimuth direction to steer the antenna beam in the azimuth direction.

7. The antenna of claim 5, wherein the antenna elements are disposed within a substrate and the steering means includes means for tilting the substrate to steer the antenna beam in the elevational direction.

8. The antenna of claim 5, wherein the steering means includes two prisms disposed adjacent the plurality of lenses.

9. The antenna of claim 8, wherein the prisms are disposed adjacent each other, having adjacent surfaces which are parallel to the antenna plane.

10. The antenna of claim 8, wherein the prisms are rotatable.

11. The antenna of claim 8, wherein the two prisms have the same prism angle and index of refraction.

12. The antenna of claim 1, wherein the lenses are fresnel lenses.

13. The antenna of claim 1, wherein the antenna is designed to receive radiation at a particular wavelength and wherein the antenna elements are patch elements having a diameter equal to one-half of the particular wavelength.

14. The antenna of claim 13, wherein the particular wavelength is within the millimeter wavelength region.

15. The antenna of claim 1, wherein said antenna elements are tilted such that a plurality of planes described by said antenna elements are substantially parallel to a plurality of planes described by said lenses.

16. The antenna of claim 15, wherein said antenna can receive radiation at a particular wavelength and wherein said antenna elements are patch elements having a diameter equal to about one-half of said wavelength.

17. The antenna of claim 15, wherein said lenses are disposed in an array, said array being disposed between two prisms and said antenna plane, each of said lenses pointing in a substantially non-perpendicular direction to said antenna plane and each of said prisms being parallel to one another and pointing in a substantially perpendicular direction to said antenna plane.

18. A method of receiving a signal, comprising the steps of:

disposing an array of lenses with respect to an array of antenna elements such that an optical axis of each of said lenses points in a direction which is at a first angle of incidence to the array of said antenna elements, said first angle of incidence being other than substantially perpendicular to an antenna plane in which said antenna elements are disposed;

using said lenses to focus radiation of a particular wavelength arriving at said lenses at said first angle of incidence and onto the array of said antenna elements; and summing the radiation of said wavelength collected by said antenna elements.

19. The method of claim 18, wherein the step of disposing includes the step of spacing two adjacent lenses apart at a lens-to-lens recess which is approximately equal to an integer multiple of the particular wavelength.

20. The method of claim 19, further including the step of using a set of two prisms to change the angle of incidence of incoming radiation with respect to the array of antenna elements from a second angle of incidence to the first angle of incidence.

21. The method of claim 20, further including the step of rotating the two prisms to change the second angle of incidence.

22. An antenna designed to receive radiation at a particular wavelength, comprising:

a plurality of antenna elements disposed in an antenna plane; and a plurality of lenses that have at least one set of two adjacent lenses disposed apart from one another by a lens-to-lens recess of approximately an integer multiple of said wavelength, said lenses being disposed adjacent said antenna elements such that each of the lenses is oriented at a particular angle of incidence with respect to said antenna plane so as to collect and focus radiation impinging on said lenses at the particular angle of incidence and onto associated antenna elements.

23. The antenna of claim 22, wherein said lenses are disposed in an array of columns and rows such that said lenses within each column are disposed substantially in a single plane and recessed with respect to each other in adjacent columns.

24. The antenna of claim 23, wherein said lenses of two adjacent columns are disposed apart by a lens-to-lens recess of approximately an integer multiple of said wavelength.

25. The antenna of claim 22, wherein said antenna elements are disposed within a substrate that can be tilted by a steering means for steering an antenna beam associated with said antenna and in an elevational direction.

26. The antenna of claim 25, wherein said steering means includes two prisms disposed adjacent said lenses, said prisms having the same prism angle and index of refraction.

27. A method of receiving a signal at a particular wavelength, comprising the steps of:

disposing an array of lenses with respect to an array of antenna elements such that each of said lenses points in a direction which is at a first angle of incidence to the array of said antenna elements, the step of disposing including the step of spacing two adjacent lenses apart at a lens-to-lens recess that is approximately equal to an integer multiple of said wavelength;

using said lenses to focus radiation of said wavelength arriving at said lenses at said first angle of incidence and onto the array of said antenna elements; and summing the radiation of said wavelength collected by said antenna elements.

28. The method of claim 27, further including the step of using a set of two prisms to change an angle of incidence of incoming radiation with respect to the array of said antenna elements from a second angle of incidence to said first angle of incidence.

29. The method of claim 28, further including the step of rotating the two prisms to change said second angle of incidence.

* * * * *